US006575649B1

(12) United States Patent
Kuan-Hsiung et al.

(10) Patent No.: US 6,575,649 B1
(45) Date of Patent: Jun. 10, 2003

(54) PEN HOLDER

(76) Inventors: Pai Kuan-Hsiung, No. 9, Alley 73, Lane 59, Ha-Mih Street, Taipei City (TW); Pai Chi-Feng, No. 9, Alley 73, Lane 59, Ha-Mih Street, Taipei City (TW)

( * ) Notice: Subject to any disclaimer, the term of this patent is extended or adjusted under 35 U.S.C. 154(b) by 0 days.

(21) Appl. No.: 10/254,820

(22) Filed: Sep. 23, 2002

(51) Int. Cl.[7] ..... B43K 23/02
(52) U.S. Cl. ..... 401/131; 401/185; 211/69.5
(58) Field of Search ..... 401/131, 88, 195, 401/52; 211/69.1, 69.5; 24/11 CT; 33/756, 761; 242/375, 375.1, 376; D19/77, 81, 82, 84

(56) References Cited

U.S. PATENT DOCUMENTS 264,593 A * 9/1882 Wright ..... 242/385.1
1,103,955 A * 7/1914 Garon ..... 242/379
1,576,965 A * 3/1926 Giese ..... 242/379.2
1,577,272 A * 3/1926 Treadaway ..... 242/379.2
1,799,688 A * 4/1931 Jaffe ..... 242/379.2
2,961,257 A * 11/1960 Carr ..... 312/183
5,094,396 A * 3/1992 Burke ..... 242/107.1
6,065,892 A * 5/2000 Smith ..... 401/209
6,419,413 B1 * 7/2002 Oliver et al. ..... 401/131

* cited by examiner

*Primary Examiner*—Gregory Huson
*Assistant Examiner*—Huyen Le

(57) ABSTRACT

An extendable elastic cord is fastened with one writing instrument which connects with a base of the pen holder for users of pen to write or take notes by drawing the pen out of the holder and the pen never separates from the base of the pen holder, wherein the said pen holder is comprised of a base which includes a left cover and a right cover, an automatic coil apparatus and a detent device. The automatic coil apparatus of the present invention consists of a bearing tube, a tube lid, a spiral spring, a winding wheel and a binding cord. The detent device of the invention includes a rubbing plate, a leaf spring, a detent rod and a spring. The automatic coil apparatus and the detent device are installed inside the body of left cover.and right cover to integrate as a whole. When the writing instrument is not utilized or after utilization, it is inserted in the base of the invention that enables the binding cord to be automatically coiled, under the control of the detent device, into the winding wheel of the bearing tube so that the cord will not hang loose outside the pen holder.

6 Claims, 5 Drawing Sheets

PEN HOLDER

BACKGROUND OF THE INVENTION

1) Field of the Invention

The present invention is related to a pen holder with an elastic cord which connects one pen and the base of the pen holder for pen users to draw the pen from the base and then write or take notes by holding the pen with extendable elastic cord. It is especially to provide a convenient way of using because the elastic cord will automatically return to its original status when the pen is inserted into the base of the pen holder after the pen users finish writing so that the cord will not hang loose outside the pen holder.

2) Description of the Prior Art

A conventional pen holder is also equipped with a flexible cord for linking a pen with the pen holder. However, the flexible cord of prior invention is twisted out of PVC string between 1 and 2 m/m ϕ in diameter and such flexible cord is shaped like a spring; the pen holder and one writing pen are fastened on the two ends of flexible cord. Hence, the spring-shaped flexible cord hangs loose between the pen holder and the pen because of its lack of an automatic coil device that enables the flexible cord to be drawn into the inner side of the pen holder. The lack of self-winding automation is also a disadvantage when people want to use the pen of prior art design to write or take notes, they have to remain in a position close to the pen holder since the length of the flexible cord is rather limited. In addition to the foregoing disadvantage, the prior art design has another disadvantage as follows. The repetitive movements of drawing the pen out of the holder and pulling the spring-shaped flexible cord to write or take notes easily result in relaxation or straightness of the flexible cord so that the cord is incapable of contracting into "spring-shaped" status; and further, it will spread over the surface of the writing desk. Under such circumstances, not only the pen holder of prior invention is inconvenient to write or take notes but the "incontractible" spring-shaped cord will occupy the space of writing desk. In view of inconvenience and incontractibility, the inventors of the invention herein conducted research and testing that culminated in the innovative improvement of the present invention.

SUMMARY OF THE INVENTION

The objective of the invention herein is to provide a pen holder with an elastic cord which connects one writing pen and an automatic coil apparatus inside the pen holder that enables most of the cord to be coiled automatically into a winding wheel of the automatic coil apparatus so that only a small part of the elastic cord is visible between the end of the writing pen and the automatic coil apparatus and it will never hang loose or occupy the space of desk.

The brief description of the drawings below is followed by the detailed description of the invention.

DETAILED DESCRIPTION OF THE INVENTION

Figure 1:
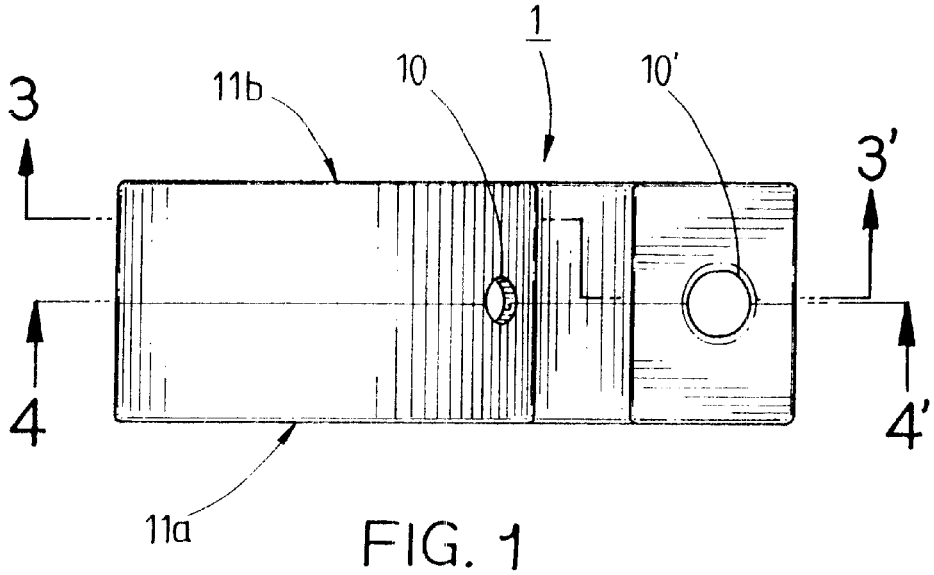
FIG. 1 is a to view of the present invention.
Figure 2:
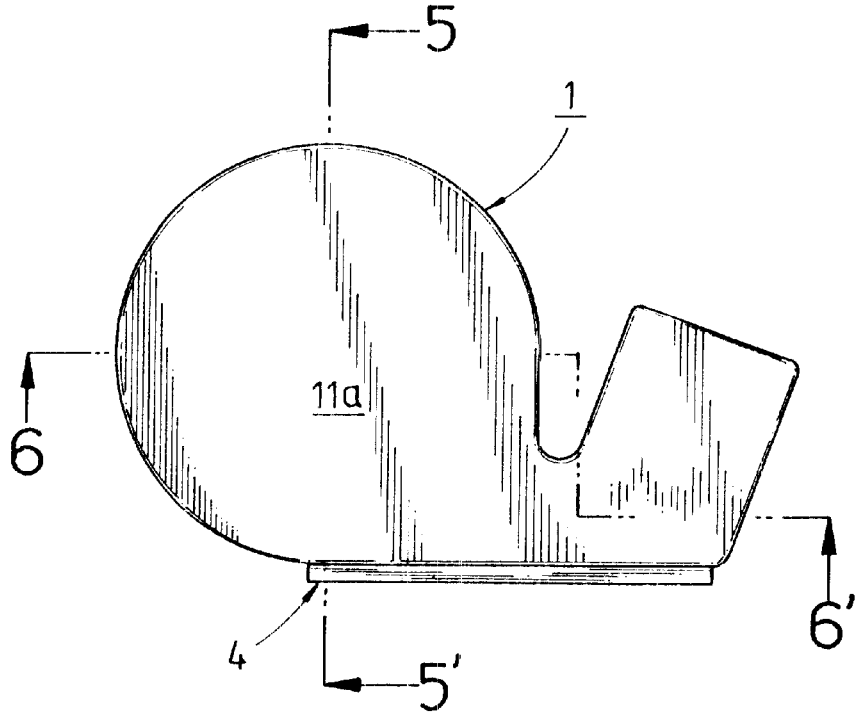
FIG. 2 is a left side view of the present invention.
Figure 3:
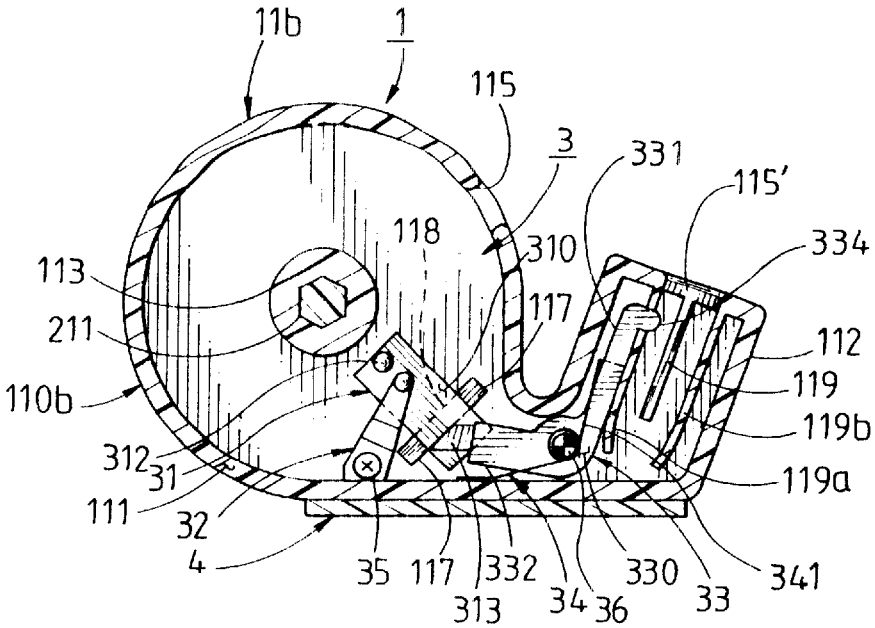
FIG. 3 is a cross-sectional view on the line 3—3' of FIG. 1.
Figure 4:
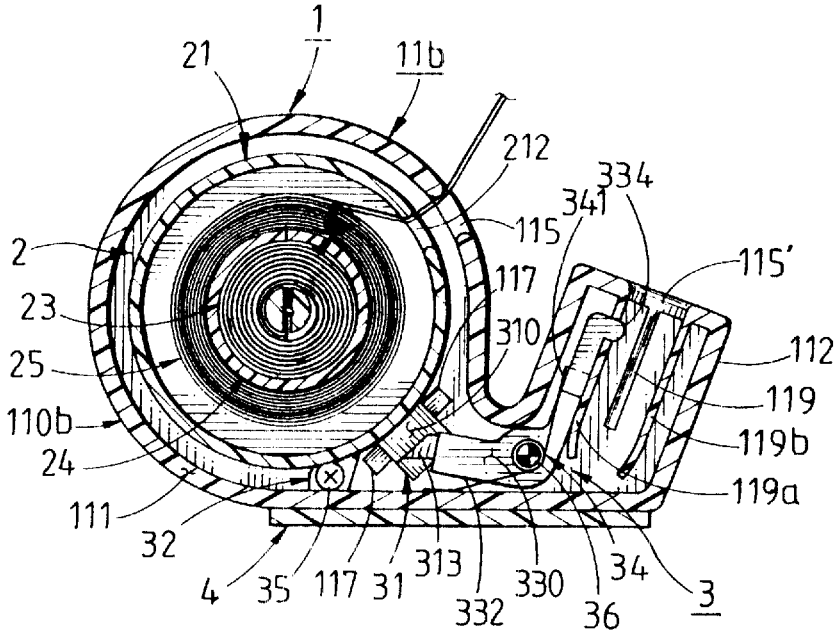
FIG. 4 is a cross-sectional view on the line 4—4' of FIG. 1.
Figure 7:
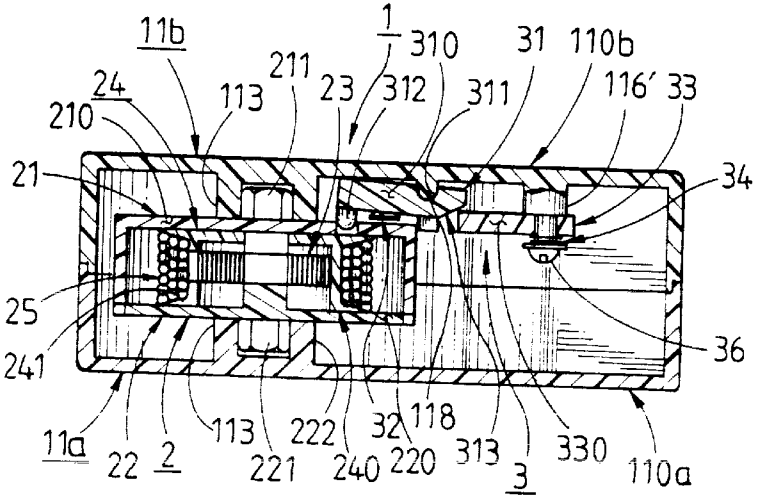
FIG. 7 is a cross-sectional view of the present invention when the detent device releases the automatic coil apparatus.
Figure 8:
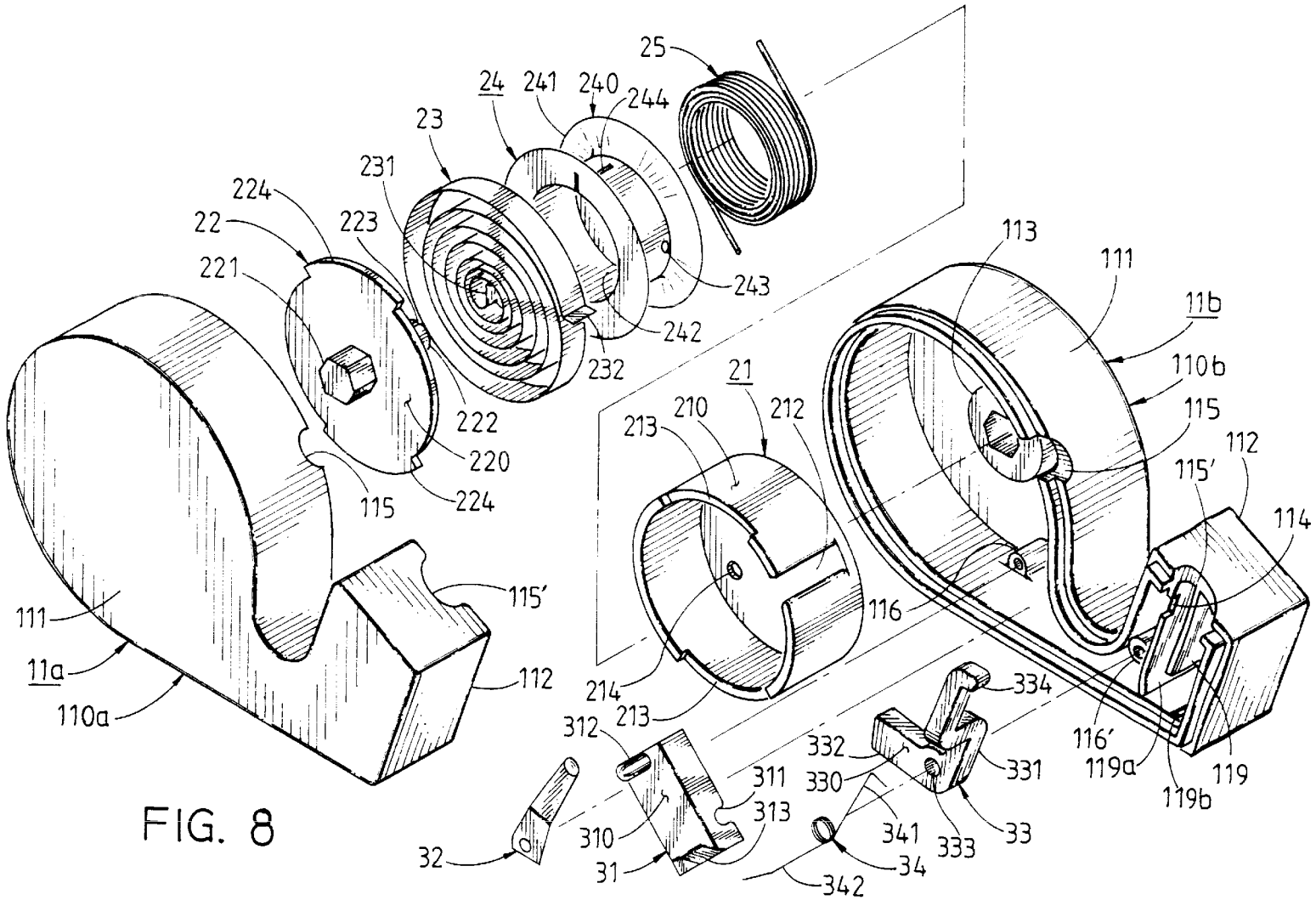
FIG. 8 is an elevation breakdown view of the present invention.
Figure 9:
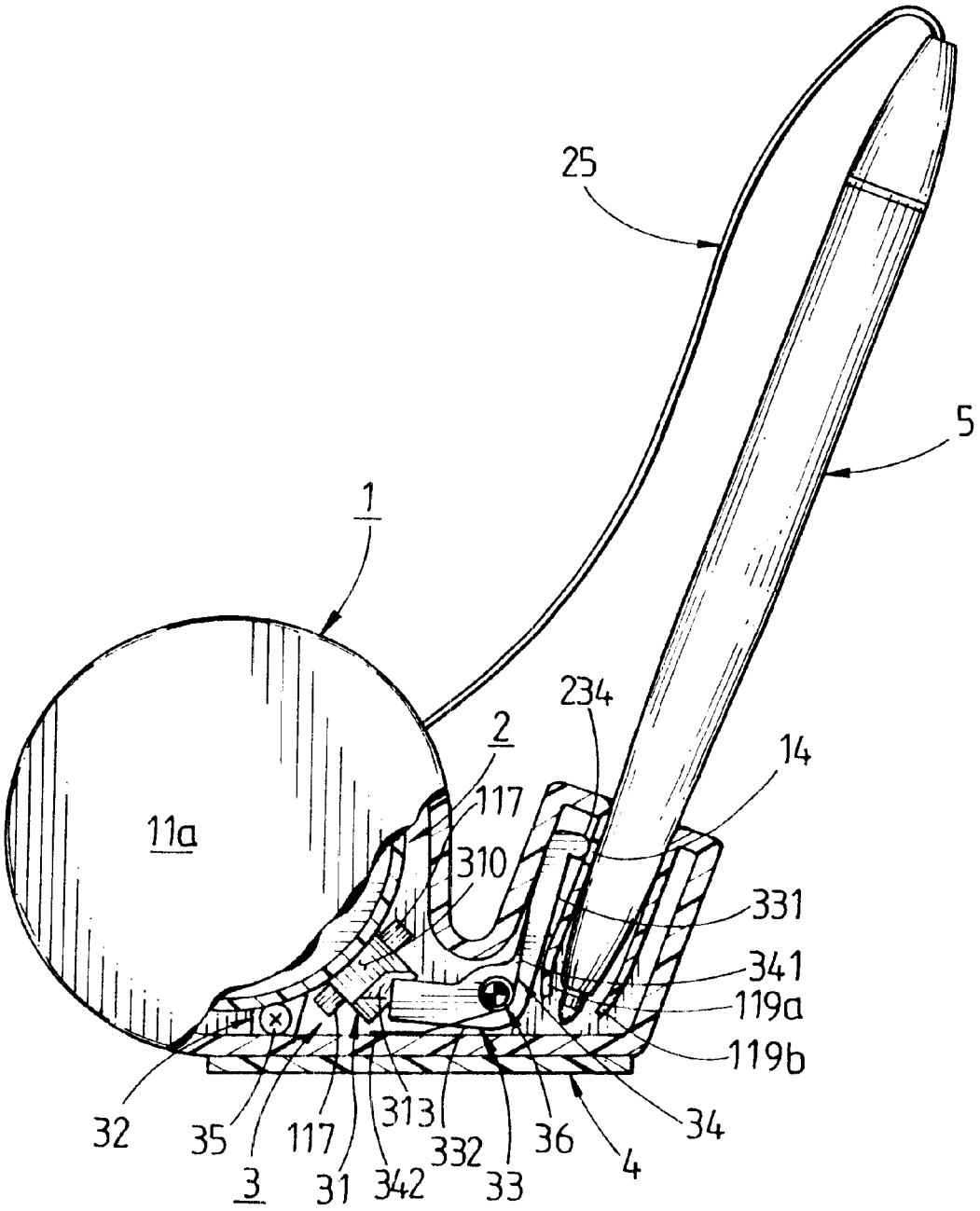
FIG. 9 is a left side view of the present invention when the writing pen with an elastic cord is inserted into the pen holder.

The present invention can be best described in detail in conjunction with a better embodiment and the accompanied drawings as follows:

Referring to FIGS. 3 and 4, the present invention is mainly comprised of a base 1, an automatic coil apparatus 2 and a detent device 3. The base 1 consists of a left cover 11*a* and a corresponding right cover 11*b* which are plastic-molded components (as shown in FIGS. 5, 6, 7 and 8.) The automatic coil apparatus 2 and the detent device 3 are installed inside the body of left cover 11*a* and right cover 11*b* to integrate as a whole. The bottom of the base 1 is molded as a flat surface to which a piece of twin adhesive tape 4 is attached (as shown in FIGS. 2, 3 and FIG. 4) so as to fix the base 1 of the pen holder onto a writing desk or a table. The horizontal U-shaped left cover body 110*a* and the corresponding right cover body 110*b* are both molded in the form of a snail, wherein each round cover body 111 of the two covers 11*a*, 11*b* has formed a protuberance 13 with a hexagonal or rectangular opening in its center so that the automatic coil apparatus 2 can be locked into each protuberance 113 that enables interlocking and conjoinment to the inner sides of the base 1. As best seen in FIG. 8, two semicircular notches 115 have formed on the edge of round cover body 111 at the rear of left cover body 110*a* and on the corresponding position of right cover body 110*b* respectively in order to comprise a through-hole 10 (as shown in FIG. 1) that enables a binding cord 25 to pass through and further to connect with one writing instrument 5 (as indicated in FIG. 9). Another pair of semicircular notches 115' has formed on each rectangular cover body 112 at the front of left cover body 110*a* and right cover body 110*b* to form a cavity 10' that enables the insertion of writing instrument 5, as indicated in FIGS. 1, 8 and 9. Two protruding tubes 116 and 116' are provided inside the lower side of round cover body 111 and rectangular cover body 112 of right cover body 110*b* for fastening a leaf spring 32 of detent device 3 and for the installation of detent rod 33 and spring 34, as indicated in FIG. 8. Moreover, a semicircular protuberance 118 with two posts 117 is provided on the upper side of protruding tubes 116 and 116' for the insertion of rubbing plate 31. In addition, in order that a writing instrument 5 can be smoothly inserted into the cavity 10' of rectangular cover body 112 after the left cover 11*a* is conjoined with the right cover 11*b*, one vertical guiding board 119 and two relatively arched guiding boards 119*a*, 119*b* are provided inside each semicircular notch 115' of rectangular cover body 112 of left cover body 110*a* and right cover body 110*b* respectively (as shown in FIG. 8). One indentation 114 has formed on the edge of arched guiding board 119*a* for the insertion of beaked border 334 of detent rod 33, as indicated in FIG. 8 and 9.

Figure 5:
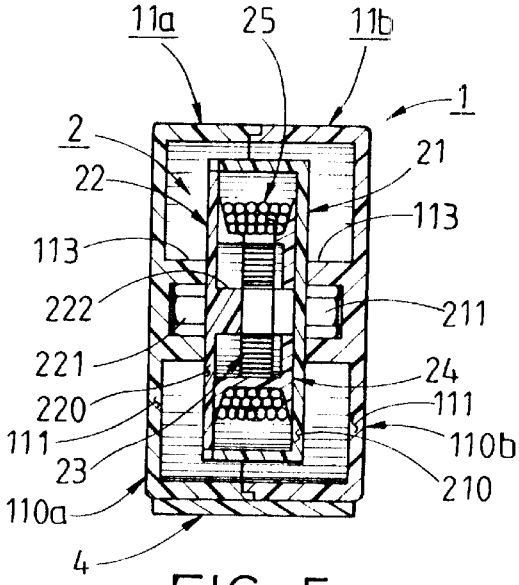
FIG. 5 is a cross-sectional view on the line 5—5' of FIG. 1.
Figure 6:
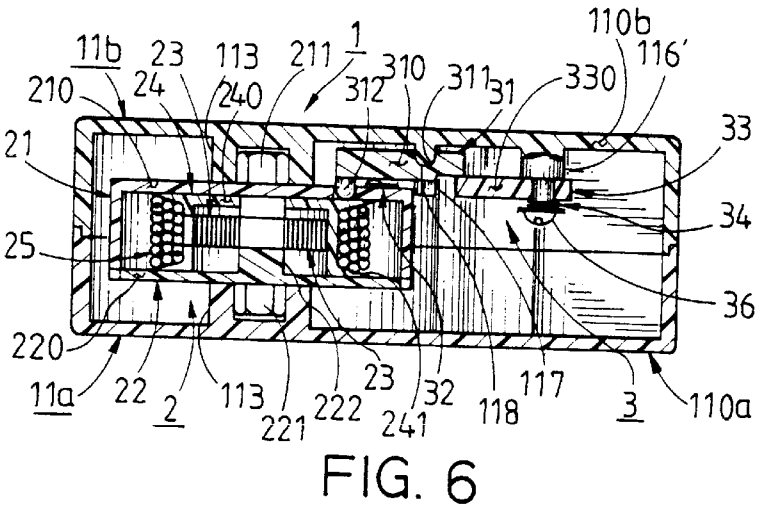
FIG. 6 is a cross-sectional view on the line 6—6' of FIG. 1.

The automatic coil apparatus 2 of the present invention, as best seen in FIG. 8, consists of a bearing tube 21, a tube lid 22, a spiral spring 23, a winding wheel 24 and a binding cord 25, wherein the bearing tube 21, the tube lid 22 and the winding wheel 24 are plastic-molded components. The bearing tube body 210 of bearing tube 21 has formed a hexagonal or rectangular post 211 in the center of the outer side thereof, as shown in FIGS. 5, 6 and 7; an indentation 212 and a hole 214 are provided thereon in order that when the binding cord 25 is rolled on the winding wheel 24, the binding cord 25 can extend and contract through the indentation 212 and a rubbing post 312 of rubbing plate 31 can be inserted into the said hole 214. Referring to FIG. 8, at least one pair of stepped bearing edges 213 is molded along the rim of bearing tube body 210 to enable the insertion and conjoinment of tube lid 22. The lid body 220 of tube lid 22 has formed a hexagonal or rectangular post 221 and a shaft 222 with a notch 223 thereon in the center of the two sides of lid body 220, and two or more projecting rims 224 are provided on the edge of lid body 220 and corresponding to the stepped bearing edges 213 of bearing tube 21 so as to fasten the bearing tube 21 and the tube lid 22 together. The winding wheel 24 consists of a wheel body 240 with a cavity 242 therein and formed along the outer periphery of wheel body 240 are broad rims 241 that enable to roll the binding cord 25 and the spiral spring 23. The wheel body 240 has formed a hole 243 and a slot 244 for fastening the binding cord 25 and the spiral spring 23 thereon. Furthermore, the binding cord 25 is twisted out of synthetic fiber or other similar tough material between 0.3 and 1 m/m ϕ in diameter or is a kind of "single-core" string made of nylon or other similar plastic material; and further, another form of binding cord 25 is a chain cord, wherein a plurality of plastic beads is tied separately on the above-mentioned synthetic fiber cord or plastic single-core string. The end of binding cord 25 is fastened upon the hole 243 of winding wheel 24, as shown in FIG. 8, and then rolled into the broad rims 241; the other end of binding cord 25 connects with a writing instrument 5, as shown in FIG. 9.

Referring to FIGS. 4 and 5, to assemble the automatic coil apparatus 2 of the present invention, a Z-shaped terminal 231 of spiral spring 23 (as illustrated in FIG. 8), is locked with the notch 223 on the shaft 222 of tube lid 22 and then emplaced in the cavity 242 of winding wheel 24; an L-shaped terminal 232 of spiral spring 23 is also locked with the slot 244 of wheel body 240. The end of binding cord 25 is fixed in the hole 243 of winding wheel 24 and the whole of binding cord 25 is coiled into the broad rims 241. After putting the above components together, you can install them into the bearing tube 21 with which the tube lid 22 is integrated perfectly. It is very convenient to assemble all parts of automatic coil apparatus 2 by hand in a short time.

Turning to FIGS. 3 and 8, the detent device 3 of the invention includes a rubbing plate 31, a leaf spring 32, a detent rod 33 and a spring 34, wherein the rubbing plate 31 and the detent rod 33 are plastic-molded components. The rubbing plate 31 is a rectangular plate body 310 in general which includes a U-shaped recess 311 at the lower side, a rubbing post 312 at the front upper side, and a contact incline 313 at the rear upper side thereof. The L-shaped rod body 330 of detent rod 33 is composed of an S-shaped vertical arm 331, a horizontal arm 332 and a hole 333 so that the detent rod 33 can be fixed on the right cover 11*b* of the base 1 by a screw 36. The end of S-shaped vertical arm 331 has formed a beaked border 334 in order to penetrate into the cavity 10' of the base 1 and further to control the mechanism of automation or start the automatic coil apparatus 2 because when the said writing instrument 5 is inserted into the cavity 10', it will push the beaked border 334 forward and then the detent rod 33 will release the automatic coil apparatus 2, thereby faciliating the binding cord 25 to be coiled into the winding wheel 24, as illustrated in FIG. 9.

Turning to FIGS. 3, 4, 6 and 7, to assemble the detent device 3 of the invention, the rubbing plate 31 is installed to the semicircular protuberance 118 between the two posts 117 on the right cover 11*b* of the base 1; next, the leaf spring 32 is fastened onto the protruding tube 116 on the right cover 11*b* by means of a screw 35 so that the rubbing plate 31 is pressed by the end of leaf spring 32; finally, the detent rod 33 and the spring 34 with two plucked shafts 341 and 342 are fastened onto the protruding tube 116' on the right cover 11*b* by means of a screw 36.

After the detent device 3 is installed and conjoined as previously described into the right cover 11*b* of the base 1, the automatic coil apparatus 2 which has been put together can be installed thereinto by combining the post 211 on the bottom of bearing tube body 210 with the corresponding opening in the center of protuberance 113 inside the right cover 11*b*, as shown in FIGS. 5, 6 and FIG. 7. Moreover, the rubbing post 312 of rubbing plate 31 is inserted into the hole 214 on the bearing tube body 210 and the post 312 is precisely against the winding wheel 24 of the automatic coil apparatus 2. The next step is putting the left cover 11*a* over the right cover 11*b* so that the opening in the center of protuberance 113 inside, the left cover 11*a* is linked together with the post 221 of tube lid 22, and then a part of binding cord 25 (which is equal to the length of the writing instrument 5, as indicated in FIG. 9) is pulled out from the automatic coil apparatus 2 and emplaced in between the semicircular notches 115 on the left cover 11*a* and right cover 11*b*, as illustrated in FIG. 8. The third step is integrating the left cover, 11*a* with the right cover 11*b* or sticking the two covers together, and thereby the assemblage of parts of base 1 is complete. Moreover, the writing instrument 5 is attached to the end of binding cord 25 passing through the hole 10 on the base 1 and further the tip of writing instrument 5 is inserted into the cavity 10', as best seen in FIG. 1. Finally, a piece of twin adhesive tape 4 is provided on the bottom of the base 1 that enables the adherence of the pen holder onto a writing desk or a table for use.

When the pen holder of the invention is not utilized, the writing instrument 5 is emplaced in the cavity 10' of the base 1 in a fixed state (as shown in FIG. 9); when the users want to write or take notes, they can take the writing instrument 5 out of the cavity 10' and pull it into an appropriate position to do the writing. After finishing writing, they just insert the writing instrument 5 into the cavity 10', the automatic coil apparatus 2 inside the base 1 of the invention can automatically wind the binding cord 25 into the winding wheel 24 of the bearing tube 21 so that a small part of binding cord 25 is visible between the base 1 and the end of the writing instrument 5. Thus, the desktop is always tidy because the pen holder of the invention does not occupy the surface of the table.

What is claimed is:

1. A pen holder with an extendable elastic cord comprising:

a base which includes a left cover and a corresponding right cover;

an automatic coil apparatus which includes a bearing tube, a tube lid, a spiral spring, a winding wheel and a binding cord; and a detent device which consists of a rubbing plate, a leaf spring, a detent rod and a spring.

2. The pen holder of claim 1 wherein said left cover and said right cover are both molded in the form of a snail with a flat bottom and said two covers are horizontal U-shaped in cross-section, further comprising:

one pair of semicircular notches formed on each of round cover body at the rear of said left cover and said right cover in order to comprise a through-hole that enables said binding cord to pass through and further to connect with one writing instrument;

another pair of semicircular notches formed on each of rectangular cover body at the front of said left cover and said right cover to form a cavity that enables the insertion of said writing instrument;

two protruding tubes provided inside said right cover for the installation of said leaf spring, said detent rod and said spring; and a semicircular protuberance with two posts provided on the upper side of said protruding tubes for the insertion of said rubbing plate.

3. As mentioned in claim 1 wherein said bearing tube of the automatic coil apparatus is a U-shaped tube body, which further includes:

a hexagonal or rectangular post on the bottom thereof, an indentation; and at least one pair of stepped bearing edges molded along the rim of bearing tube body.

4. The automatic coil apparatus of claim 1 wherein:

said tube lid has formed a hexagonal or rectangular post and a shaft with a notch in the center of the two sides of tube lid body, further comprising two or more projecting rims provided on the edge of tube lid body and corresponding to said stepped bearing edges;

said winding wheel is a wheel body with a cavity therein and broad rims formed along the outer periphery thereof, further comprising a hole and a slot thereon so that the end of binding cord is fixed in said hole and then the whole of binding cord is coiled into said broad rims;

said binding cord is a cord twisted out of synthetic fiber or other similar tough material; or a single-core string made of nylon or other similar plastic material; or a chain cord connected with a plurality of plastic beads.

5. The automatic coil apparatus of claim 1 wherein said spiral spring includes:

a Z-shaped terminal locked with said notch on the shaft of said tube lid and then emplaced in said cavity of the winding wheel; and an L-shaped terminal locked with said slot on the winding wheel.

6. The detent device of claim 1 wherein:

said rubbing plate is molded with a U-shaped recess at the lower side, a rubbing post at the front upper side, and a contact incline at the rear upper side thereof that enables the fastening and conjoinment to said semicircular protuberance with two posts inside said right cover;

said detent rod is an L-shaped rod body, which further includes:

an S-shaped vertical arm, a horizontal arm, a beaked border and a hole so that the detent rod can be fixed, by using a screw to thread through said hole, into the protruding tube on the front side of said right cover;

said leaf spring is fastened onto the protruding tube in the rear of said right cover by means of a screw in order that the rubbing plate can be pressed by the end of leaf spring; and said spring is a metal spring with two plucked shafts which are fastened, together with said detent rod, onto the protruding tube on the front side of said right cover by means of a screw.

* * * * *